US008496214B2

(12) United States Patent
Fichter et al.

(10) Patent No.: US 8,496,214 B2
(45) Date of Patent: Jul. 30, 2013

(54) ANTI-TIP STABILITY SYSTEM INTEGRAL TO AN IMAGING APPARATUS

(75) Inventors: Dustin Daniel Fichter, Lexington, KY (US); Jason Lee Rowe, Richmond, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 376 days.

(21) Appl. No.: 12/717,247

(22) Filed: Mar. 4, 2010

(65) Prior Publication Data

US 2011/0042545 A1 Feb. 24, 2011

Related U.S. Application Data

(60) Provisional application No. 61/235,530, filed on Aug. 20, 2009.

(51) Int. Cl.
*F16M 11/24* (2006.01)

(52) U.S. Cl.
USPC ..... 248/188.2; 248/188.8; 248/346.05

(58) Field of Classification Search
USPC ..... 248/188, 188.1, 188.2, 188.3, 188.7, 248/188.8, 188.9, 188.91, 346.05; 5/509.1
See application file for complete search history.

(56) References Cited

U.S. PATENT DOCUMENTS

| | | | | |
|---|---|---|---|---|
| 2,933,850 | A * | 4/1960 | Martin | 248/188.2 |
| 4,461,446 | A * | 7/1984 | Hannibal et al. | 248/634 |
| 5,967,472 | A * | 10/1999 | Wilhelmstatter et al. | 248/188.4 |
| 6,032,589 | A * | 3/2000 | Wang | 108/147.11 |
| 6,302,543 | B1 * | 10/2001 | Arai et al. | 353/70 |
| 6,409,138 | B1 * | 6/2002 | Baccini | 248/346.01 |
| 6,473,152 | B1 * | 10/2002 | Yokota | 355/30 |
| 7,551,874 | B2 * | 6/2009 | Marumoto | 399/107 |

* cited by examiner

*Primary Examiner* — Terrell McKinnon
*Assistant Examiner* — Steven Marsh

(57) ABSTRACT

An imaging apparatus having a printer frame, a media tray frame module disposed below the printer frame, and an anti-tip stability system including two alignment posts mounted substantially diagonally on the media tray frame module. The alignment posts have first surfaces and second surfaces where each second surface makes an acute angle ranging from about 10 degrees to about 20 degrees with a horizontal plane. The alignment posts provide anti-tip stability to the imaging apparatus by engaging with the printer frame when the printer frame is tilted at a first contact angle with respect to the alignment posts due to the application of an external force. The alignment posts also facilitate relatively easy separation of the printer frame from the media tray frame module.

24 Claims, 12 Drawing Sheets

ANTI-TIP STABILITY SYSTEM INTEGRAL TO AN IMAGING APPARATUS

CROSS REFERENCE TO RELATED APPLICATION

This application is related to and claims the benefit of the earlier filing date of Application Ser. No. 61/235,530, filed Aug. 20, 2009, entitled "Imaging Device and Method of Making and Operating Same."

BACKGROUND OF THE INVENTION

1. Field of the Invention

The present invention relates generally to an imaging apparatus having an anti-tip stability system and particularly to an imaging apparatus having an anti-tip stability system that prevents a printer frame from tipping off a media tray frame module when an external force is applied to the printer frame and still allowing the printer frame to be easily removed from the media tray frame module.

2. Description of the Related Art

An imaging apparatus, such as a printer, a copier, or a multi-function printing device (MFP) typically includes an input media tray for supplying media sheets to the imaging apparatus. Present day imaging apparatus often include more than one input media tray, positioned below a printer module, to provide more options to a user with regard to the type of input media sheet being used. For example, the user might want to use paper or transparency sheets having a variety of sizes as input media sheets for the imaging apparatus to process at different times, depending upon the need of the user. In such a case, instead of requiring the user to manually change the media stack in the input media tray, it is advantageous for the user to have an imaging apparatus that has multiple input media trays where each input media tray stores a different type of input media sheet.

However, as the number of input media trays increases, the height and weight of the imaging apparatus also increase, leading to a decreased tip stability of the imaging apparatus. This has led to a more stringent Underwriter Laboratories (UL) requirement for anti-tip stability of a system that necessitates an imaging apparatus to be tested for an increased external force that it can withstand without tipping the printer module off of the below-lying input media trays. However, a common failure mode of the imaging apparatus in the anti-tip stability test is the separation of the printer module from the input media trays.

An existing approach to solve the above problem is to provide bracket assemblies for the input media trays. When the user or a service engineer receives the shipment of the imaging apparatus along with the input media trays and the bracket assemblies, he manually attaches the bracket assemblies between the printer module and the input media trays to prevent the printer module from tipping off of the input media trays when the imaging apparatus is tilted. However, this method requires user intervention. Further, if this operation is not performed by the user, it may result in safety hazards.

Another approach, executed by Lexmark® for their C75x class of products, makes use of a single metal post in the form of a Christmas tree with branches that are parallel to the horizontal plane. Once the printer module is positioned over the media trays, the branches of the single metal post allow a tight fitting between the printer module and the media trays. However, the disadvantage of this approach is that the user faces difficulty while removing the printer module from the input media trays for maintenance purposes due to the tight fitting being provided by the branches. Also, the branches being parallel to the horizontal plane, in order to remove the printer module off the below-lying input media trays, the user has to pull the printer module exactly vertically up, which owing to the height and weight of the printer module becomes troublesome for the user.

Thus, the existing methods have the disadvantages of user intervention, possibilities of safety hazards, and difficulty in separating the printer module from the input media trays when required. Consequently, there is a need for an imaging apparatus having an integral anti-tip stability system that provides high anti-tip stability to the imaging apparatus and also provides the user a means for easy removal of the printer module from the media trays when required.

SUMMARY OF THE INVENTION

Exemplary embodiments of the present invention overcome the shortcomings associated with prior securement systems and thereby satisfy a significant need for an anti-tip mechanism which stably secures a printer module to a media tray frame while allowing for relatively easy removal of the printer module therefrom. According to the exemplary embodiments, there is shown an apparatus having a system for providing anti-tip stability, including a frame having at least one opening along the bottom surface thereof; a frame module being disposed below the frame; and at least one alignment post disposed on the frame module such that the alignment post is received within the opening of the frame. The alignment post has a central section with a cynlindrically shaped bore defined through it, and a plurality of first surfaces disposed at least partly around and along the central section. Each first surface flares outwardly from a top end to a bottom end thereof. The alignment post further includes a plurality of second surfaces, each of the plurality of second surfaces being inwardly tapered from a bottom end of one of the first surfaces to a top end of another first surface such that the first and second surfaces alternate between a top of the alignment post and a bottom thereof. Each second surface makes a predetermined acute angle $\beta$ with a horizontal plan.

In some embodiments, the predetermined angle between each second surface and the horizontal plane is an acute angle ranging from about 10° to about 20°.

Each of the second surfaces is positioned along the alignment post for engaging the frame and creating a counterforce that substantially prevents the frame and a frame module from separating when the frame moves relative to at least one second surface at a first contact angle.

Further, when the frame moves relative to at least one second surface at a second contact angle, the counterforce created by engagement of the frame with the second surface does not prevent the frame from being separated from the frame module, the second contact angle being less than the first contact angle.

In yet another aspect of the invention, there is disclosed an apparatus having a system for providing anti-tip stability to the apparatus. The apparatus has a frame including a bottom surface having at least one opening, a frame module disposed below the frame, and at least one alignment post disposed on the frame module such that the alignment post is received by the opening of the frame. The alignment post has a central cylindrical section and a plurality of first surfaces disposed at least partly around and along the central cylindrical section, each first surface being outwardly flared from the central cylindrical section between a top end and a bottom end of the first surface. The alignment post further includes a plurality of second surfaces, each of the plurality of second surfaces being tapered inwardly from a tip of the bottom end of a respective one of the plurality of first surfaces to a top end of another first surface. Each second surface makes a predetermined angle β with a horizontal plane.

In some embodiments, the alignment post includes at least one flat portion disposed partly around the central cylindrical section in proximity with corresponding first and second surfaces. The flat portions provide sufficient clearance for allowing the frame to be lifted relatively easily from the frame module. The flat portions of each alignment post face a center portion of the frame module so that the first and second surfaces of the alignment post are able to engage the frame and prevent tipping action due to application of a tipping force thereon.

DETAILED DESCRIPTION

Figure 1:
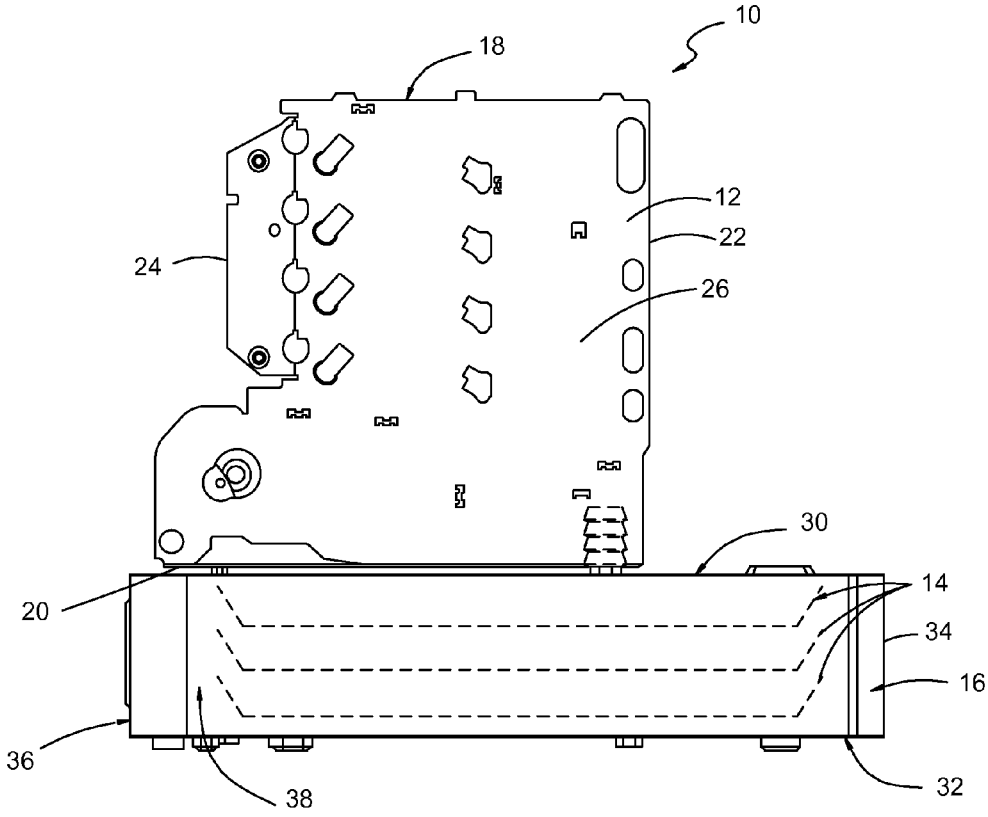
FIG. 1 is a side elevational view of an imaging apparatus.

Reference will now be made in detail to the exemplary embodiment(s) of the invention as illustrated in the accompanying drawings. Whenever possible, the same reference numerals will be used throughout the drawings to refer to the same or like parts.

FIG. 1 illustrates a side elevational view of an imaging apparatus 10. The imaging apparatus 10 includes a printer frame 12 covering a printer module (not shown) and has one or more media trays 14 positioned beneath the printer frame 12. The printer module includes internal components commonly found in a printing device, such as one or more image transfer stations, a toner fuser and a media feedpath for moving media between an input tray, the image station, the toner fuser and a media output tray (not shown). The one or more media trays 14 can be both input media trays as well as output media trays that are enclosed by a media tray frame module 16. The one or more media trays 14 are removable from the media tray frame module 16 for refilling from time to time. The printer frame 12 includes a top surface 18, a bottom surface 20, a front 22, a back 24, a left side 26, and an opposing right side (not shown). The media tray frame module 16, similar to the printer frame 12, also has a top surface 30, a bottom surface 32, a front 34, a back 36, a left side 38, and an opposing right side 40 (FIG. 3).

Figure 2:
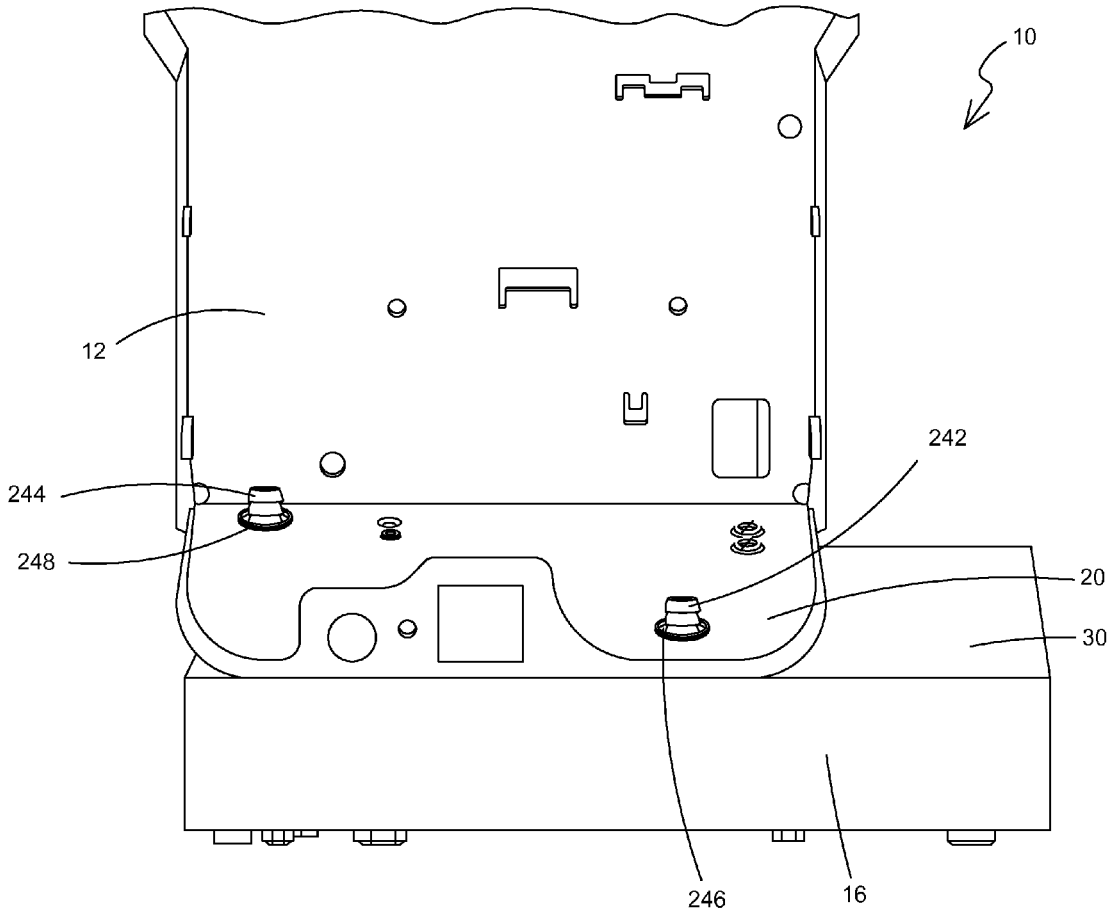
FIG. 2 is a perspective view of one embodiment of a portion of a printer frame, a media tray frame module, and two alignment posts of the imaging apparatus of FIG. 1 according to an exemplary embodiment of the present invention.

FIG. 2 shows a cross-sectional perspective view of a portion of the printer frame 12, the media tray frame module 16 positioned below the printer frame 12, and two identical alignment posts 242, 244. For the sake of clarity, the printer module that is enclosed by the printer frame 12 and the media trays 14 that are enclosed by the media tray frame module 16 are not shown in FIG. 2. The alignment posts 242, 244 are mounted on the top surface 30 of the media tray frame module 16 and are disposed diagonal to each other on the media tray frame module 16. Alternatively, the alignment posts 242, 244 may also be located along the same side of the media tray frame module 16 as well. The printer frame 12 has two openings 246, 248 at its bottom surface 20 to receive the respective alignment posts 242, 244. The alignment posts 242, 244 provide anti-tip stability to the imaging apparatus 10 by preventing the printer frame 12 (along with the printer module therein) from tipping off the media tray frame module 16 when an external force is applied on the printer frame 12. According to one embodiment of the present invention, the alignment posts 242, 244 can also be used to provide anti-tip stability between multiple media tray frame modules 16 that may be stacked beneath the printer frame 12.

Figure 3:
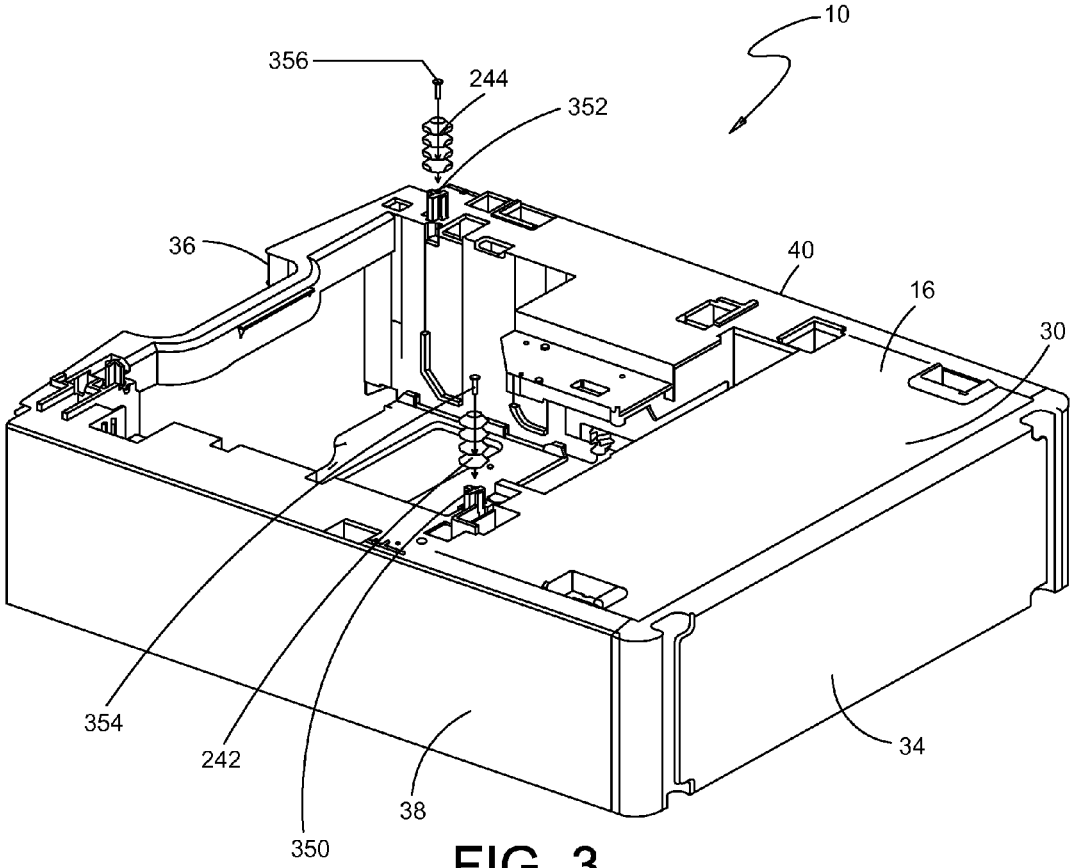
FIG. 3 is an exploded, perspective view of the alignment posts on a media tray frame module according to an exemplary embodiment of the present invention.

FIG. 3 is an exploded view of one embodiment of the present invention illustrating how each alignment post 242, 244 is mounted on the media tray frame module 16 according to the present invention. The media tray frame module 16 has slots 350, 352 on its top surface 30 to receive screws 354, 356, respectively. Each screw 354, 356 is inserted into the corresponding alignment posts 242, 244 from above (also shown in FIG. 4) and is received by the corresponding slots 350, 352 in the media tray frame module 16, thereby attaching the alignment posts 242, 244 to the top surface 30 of the media tray frame module 16. Since the alignment posts 242, 244 are screwed to the media tray frame module 16, the alignment posts 242, 244 become an integral part of the media tray frame module 16, thereby eliminating the need of any user intervention to mount the alignment posts 242, 244 to the media tray frame module 16 of the imaging apparatus 10 as observed in existing systems. Attaching the alignment posts 242, 244 via screws 354, 356 is one of the possible ways of fastening the alignment posts 242, 244 to the media tray frame module 16 and it is understood that other fastening methods can be used.

Figure 4:
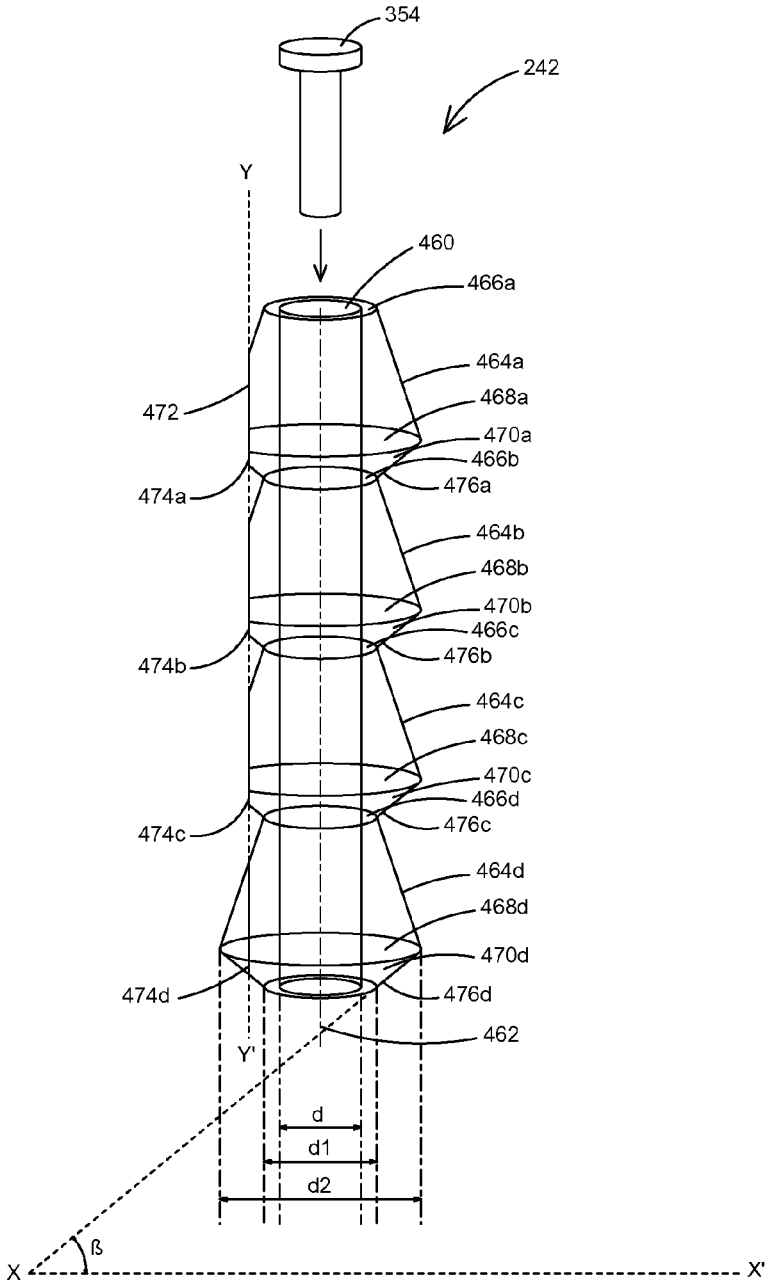
FIG. 4 is a perspective view of one of the alignment posts of FIGS. 2 and 3.

FIG. 4 illustrates a perspective view of one embodiment of the structure of the alignment post 242, 244 according to the present invention. The alignment post 242 has a hollow central cylindrical section 460 that has a central longitudinal axis 462 perpendicular to a horizontal plane X-X'. Section 460 may have a diameter d. The screw 354 passes through the hollow central cylindrical section 460 in order to attach the alignment post 242 to the slot 350 (not shown in FIG. 4) of the media tray frame module 16 (as shown in FIG. 3). Each of two or more identical first surfaces 464*a*-464*d* (four first surfaces are shown in FIG. 4) extend outwardly and downwardly from the central cylindrical section 460, thereby forming an outwardly flared exterior surface. First surfaces 464 are mounted above and below each other along central axis 462 in a stacked arrangement. Each first surface 464*a*-464*d* extends between a top end 466*a*-466*d* and a bottom end 468*a*-468*d*, the top ends 466*a*-466*d* having a first diameter d1 and the bottom ends 468*a*-468*d* having a second diameter d2. The geometry of the first surfaces 464*a*-464*d* is such that the first diameter d1 is smaller than the second diameter d2, making each first surface have at least a partial frustoconical shape. Also, the first diameter d1 is either larger than or equal to the fixed diameter d of the central cylindrical section 460.

From the respective bottom end 468 of each first surface 464, a second surface 470 extends downwardly and inwardly towards the central cylindrical section 460, thereby defining an inwardly tapered exterior surface. Each second surface 470 connects the bottom end 468 of a respective first surface 464 with the top end 466 of an adjacent first surface 464. For example, the second surface 470*a* connects the bottom end 468*a* of the first surface 464*a* with the top end 466*b* of the adjacent first surface 464*b*. Each of these second surfaces 470*a*-470*d* makes a predetermined acute angle β with a horizontal plane X-X', as shown in FIG. 4, and acts as a hook, barb and/or catch with which the printer frame 12 engages when the printer frame 12 is lifted at or tilted to a certain angle with respect to the alignment post 242, 244. According to one embodiment of the present invention, the predetermined angle β ranges from about 10 degrees to about 20 degrees.

FIG. 4 further shows a flat portion 472 on the alignment post 242, 244 that is substantially parallel to the central axis 462. The flat portions 472 represent a cut portion (along a vertical plane Y-Y') of the first surfaces 464 and flat portions 474 represent cut portions along second surfaces 470 of the alignment posts 242, 244. The flat portions 474 of the second surfaces 470 are spaced from central axis 462 such that the second surfaces 474 do not engage the printer frame 12 when the printer frame is lifted or tilted to a certain angle with respect to the alignment posts 242, 244 and thereby provide sufficient clearance for relatively easy removal of printer frame 12 from media tray frame module 16. The partially frustoconically shaped portions 476*a*-476*d* of the second surfaces 470*a*-470*d*, unlike their counterpart flat portions 474*a*-474*d* thereof, are capable of engaging the printer frame 12 when lifted or tilted relative to the alignment posts 242, 244, as will be explained in further detail below.

A benefit has been discovered in having a relatively tall alignment post 242, 244, i.e., an alignment post having a larger number of first surfaces 464 and second surfaces 470 for an imaging apparatus having a relatively larger footprint. The reason being, when the imaging apparatus has a greater length and width (i.e., a large footprint), the tip radius, which is equal to either the length or width of the imaging apparatus depending upon the direction of application of an external tipping force applied to the printer frame 12 of the imaging apparatus, is relatively high. In that case, there is a possibility that the printer frame 12 may not engage with a first second surface 470*d* disposed at the bottom of alignment posts 242, 244 and thus may engage with second surfaces 470*c* or 470*b* that are more spaced from the bottom of alignment posts 242, 244.

Figure 5:
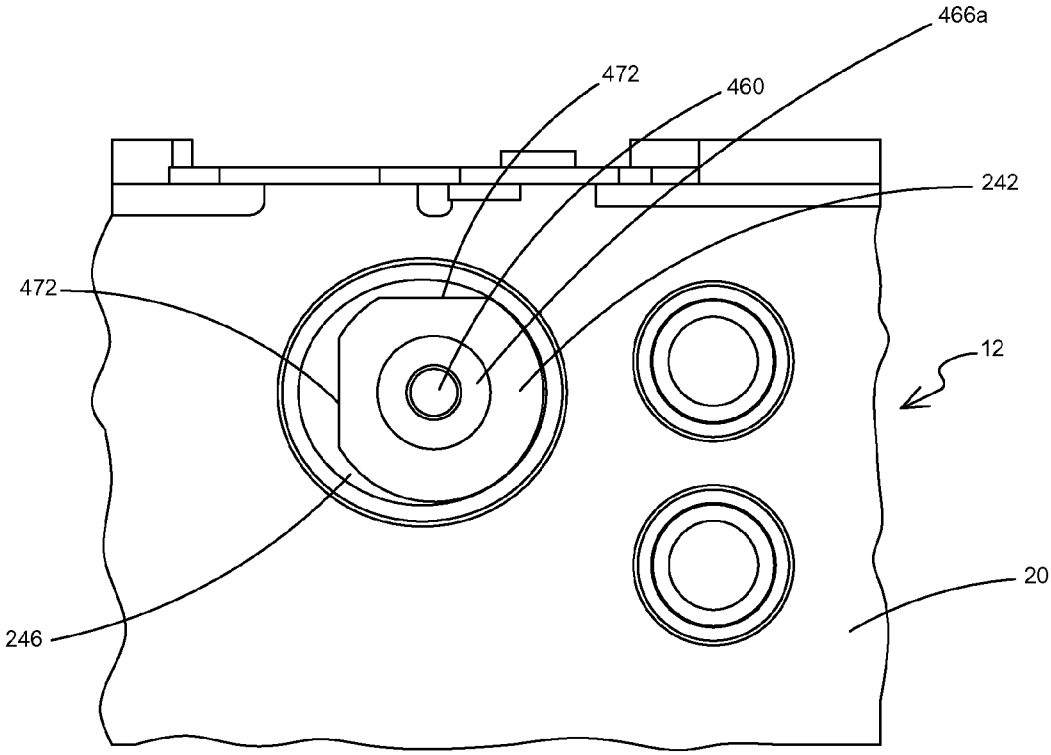
FIG. 5 is a top view of one of the alignment posts of FIG. 3 received in the printer frame.

According to one embodiment of the present invention, each alignment post 242, 244 has two flat portions 472 and two flat portions 474 disposed adjacent to each other. FIG. 5 illustrates a top view of the alignment post 242 and the opening 246 of the printer frame 12 showing the two adjacent flat portions 472. As shown in FIG. 5, the two adjacent portions 474 provide a clearance gap between the alignment post 242 and the edge of printer frame 12 defining the opening 246. The clearance gap provided by the flat portions 472 helps in the relatively easy removal of the printer frame 12 from the media tray frame module 16 disposed underneath printer frame 12. Due to the presence of the flat portions 472 in the alignment post 242, at least two alignment posts 242, 244 may be utilized as will be explained in further detail below.

Figure 6:
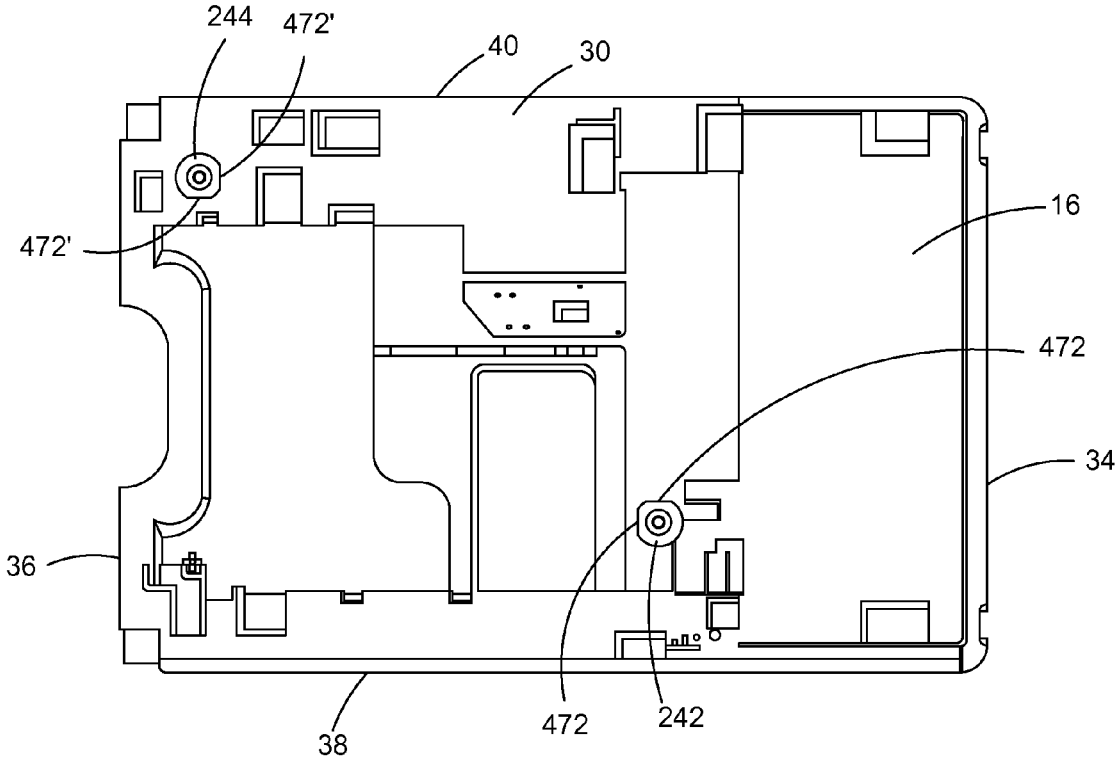
FIG. 6 is a top view of the alignment posts of FIGS. 2 and 3 mounted on the media tray frame module.

FIG. 3 shows a perspective view and FIG. 6 shows a top view of the media tray frame module 16 and the two alignment posts 242, 244 mounted on the top surface 30 of the media tray frame module 16. Alignment posts 242, 244 are positioned substantially diagonally along the media tray frame module 16. Alignment post 242 is positioned towards the front 34 and the side 38 of the media tray frame module 16, and the alignment post 244 is positioned adjacent to the back 36 and the side 40 of the media tray frame module 16. FIG. 6 further illustrates that flat portions 472 of the alignment post 242 do not face the front 34 and side 38 of the media tray frame module 16, and the flat portions 472' of the alignment post 244 do not face the back 36 and side 40 of the media tray frame module 16. In other words, the flat portions 472, 472' of each alignment post 242, 244, respectively, are directed inwardly, towards a center portion of media tray frame module 16. The reason for this positioning will be discussed in further detail below.

A situation may arise in which a user may wish to remove the printer frame 12 from the below-lying media tray frame module 16. Exemplary embodiments of the present invention provide a relatively easy approach for doing so while at the same time provide for enhanced anti-tip stability by withstanding application of a fair amount of external tipping force.

Figure 7:
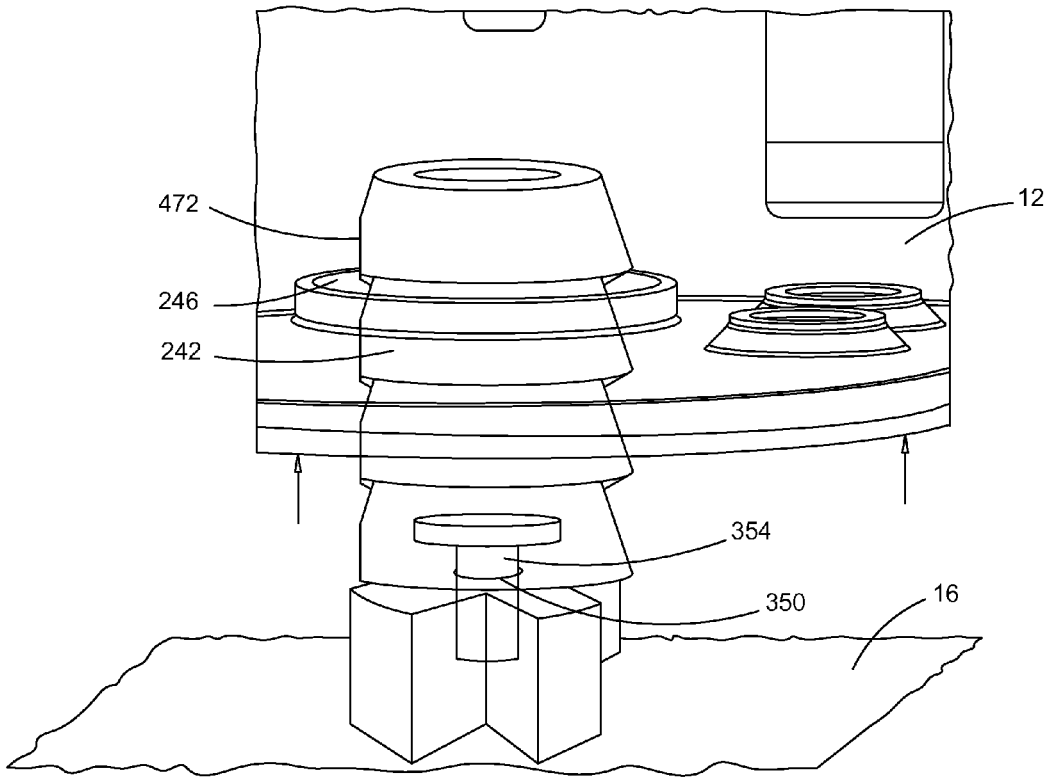
FIGS. 7 and 8 illustrate the removal of the printer frame from the media tray frame module in connection with the alignment post of FIG. 6.

FIG. 7 shows the removal of the printer frame 12 from the media tray frame module 16 when the printer frame 12 is lifted nearly vertically upwardly (shown by arrows). Under normal circumstances, when the printer frame 12 is lifted nearly vertically upwardly, the opening 246 of the printer frame 12 slides up the alignment post 242 without making any contact therewith. The flat portions 472 of the alignment post 242 provide a sufficiently sized clearance gap for the easy removal of the printer frame 12 from the alignment post 242, and thereby, from the media tray frame module 16.

However, the printer frame 12 might accidentally shift during lifting and contact the partial frustoconical portion 476 of at least one second surface 470 of either of the alignment posts 242, 244. When the printer frame 12 is lifted substantially vertically upwardly (shown by arrows in FIG. 8) and the printer frame 12 contacts the portion 476 of the at least one second surface 470, an external force F acting substantially vertically upwardly will be applied to the second surface 470. Since the second surface 470 forms an acute angle β with the horizontal plane X-X', a relatively high magnitude counterforce $F_{RX}$ acting outwardly from the alignment post 242 is generated along the portion 476 of the second surface 470. This relatively high magnitude counterforce $F_{RX}$ helps the printer frame 12 to slide off the portion 476 of the second surface 470, thereby allowing the printer frame 12 to be removed relatively easily from the alignment post 242 and in turn from the media tray frame module 16.

Figure 9:
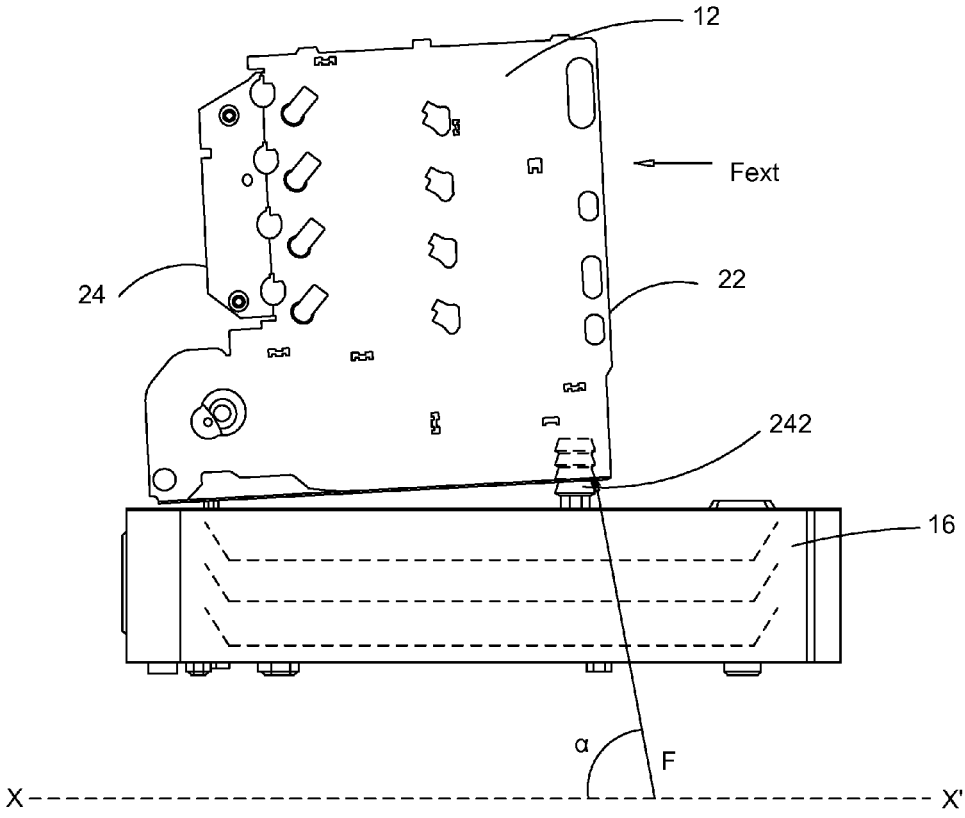
FIG. 9 is a side elevational view of the imaging apparatus of FIG. 1 showing the application of a front-to-back external force on the printer frame according to the present invention.
Figure 10:
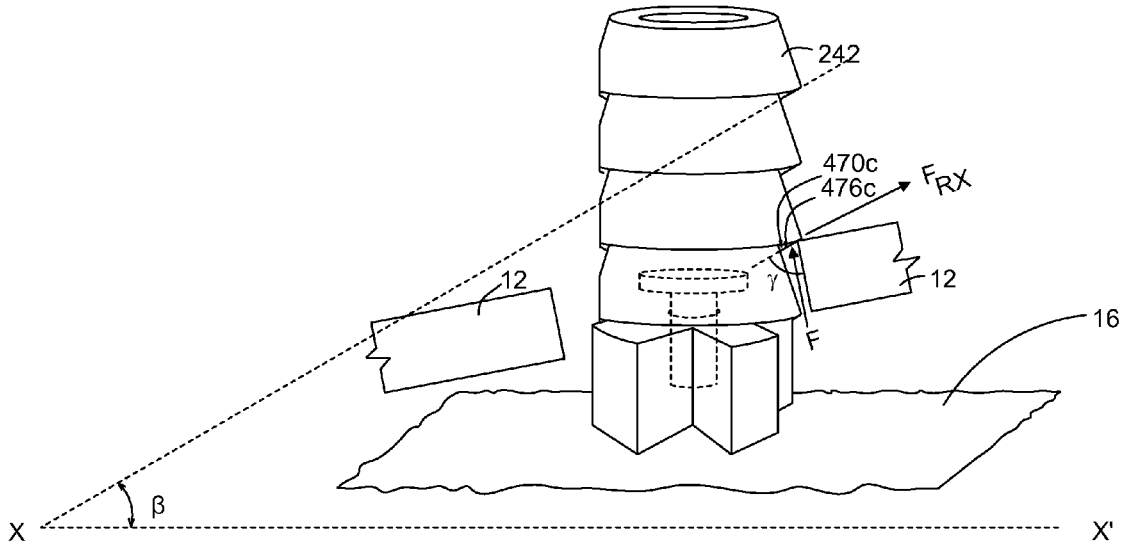
FIG. 10 illustrates anti-tip engagement of the printer frame to the media tray frame module due to application of the front-to-back external force on the printer frame as shown in FIG. 10.

The structure and positioning of the alignment posts 242, 244 provide a relatively high anti-tip stability to the imaging apparatus 10 to withstand an amount of external tip forces applied thereto. FIGS. 9 and 10 show the application of a front-to-back external tipping force $F_{ext}$ to the printer frame 12. As the external force $F_{ext}$ is applied on the printer frame 12, the printer frame 12 is tilted with respect to the alignment post 242 and the media tray frame module 16. Consequently, the printer frame 12 comes in contact with at least one second surface 470 of the alignment post 242 and a force F acts on the second surface 470 at an angle α with respect to the horizontal plane X-X'.

The application of the external force $F_{ext}$ causes the printer frame 12 to tilt relative to the alignment post 242 and engage one of the second surfaces 470 of the alignment post 242, thereby applying force F on the second surface 470 of the alignment post 242. Due to the second surface 470 making a predetermined angle β with the horizontal plane X-X', a counterforce $F_{RX}$ is generated acting outwardly from the alignment post 242 along the portion 476 of the second surface 470. Depending upon the magnitude of counterforce $F_{RX}$, the printer frame 12 either slides off the alignment post 242 or remains engaged to the second surface 470 (as shown in FIG. 10). The magnitude of $F_{RX}$ is dependent upon the relative angle γ that the printer frame 12 makes with the second surface 470.

Figure 8:
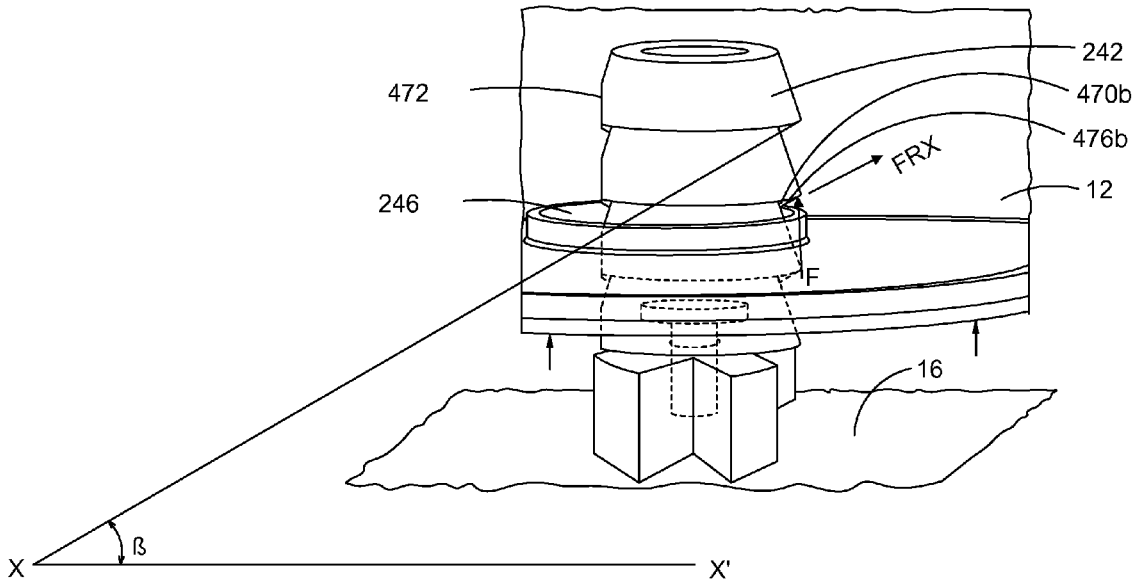
Figure 11:
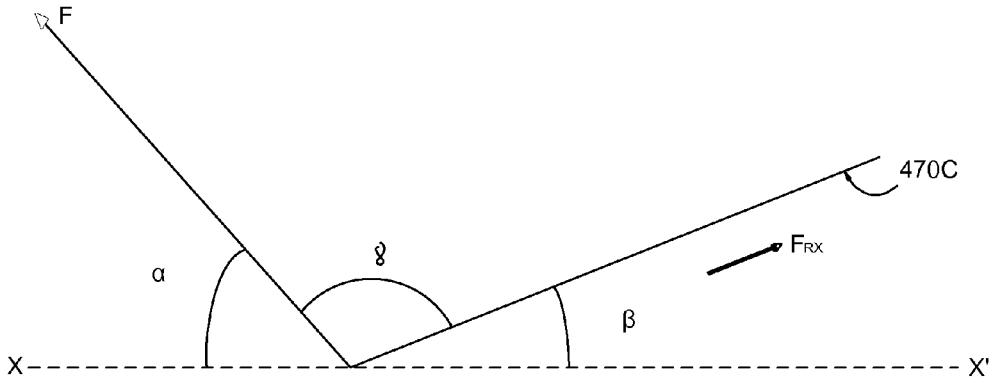
FIG. 11 shows different angles involved in the acts illustrated in FIGS. 7-10.

FIG. 11 illustrates different angles involved in the process of removal or engaging of the printer frame 12 from/to the media tray frame module 16 illustrated in FIGS. 8-10. The printer frame 12 will be engaged with or separated from the alignment post 242, 244 based on the angle α that the force F makes with the horizontal plane X-X', keeping the predetermined angle β constant. When any external force $F_{ext}$ is applied on the printer frame 12, as discussed above, the printer frame 12 moves relative to the alignment post 242, 244, thereby making an angle γ with the second surface 470. The relationship between α, β, and γ is given by the formula:

$$\gamma=180-(\alpha+\beta).$$

When the force F is applied on the second surface 470 that makes an angle α ranging from about 0 degrees to about 37 degrees with the horizontal plane X-X', keeping the predetermined angle β at about 15 degrees, the printer frame 12 moves relative to the second surface 470 at a first contact angle γ ranging from about 128 degrees to about 165 degrees, using the above formula. In that case, the printer frame 12 engages with the alignment post 242 due to the lower magnitude of the counter force $F_{RX}$ acting outwardly from the alignment post 242 along the second surface 470, thereby preventing the printer frame 12 from separating or tipping from the media tray frame module 16. However, if the force F makes an angle α ranging from about 38 degrees to about 90 degrees with the horizontal plane and β is taken to be about 15 degrees, the printer frame 12 moves relative to the second surface 470 at a second contact angle γ ranging from about 75 degrees to about 127 degrees. In that case, the printer frame is separated from the media tray frame module due to the higher magnitude of the counter force $F_{RX}$ acting outwardly from the alignment posts 242 along the second surface 470. Thus, even when α is not exactly 90 degrees, i.e., the printer frame 12 is not lifted upwardly vertically or near vertically, the printer frame 12 is nevertheless separated from the media tray frame module 16. The exemplary embodiments of the present invention, therefore, provide more flexibility to the user because the user is now capable of separating the printer frame 12 from the media tray frame module 16 even when the user lifts the printer frame 12 at an angle between about 75 degrees and about 127 degrees.

Figure 12:
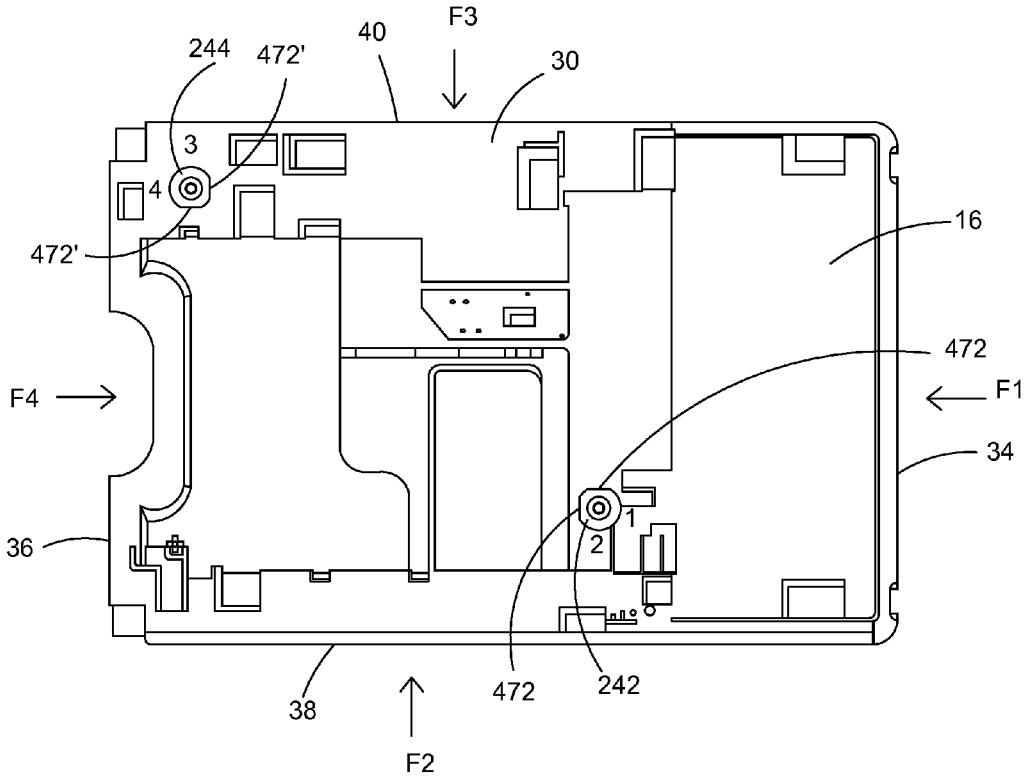
FIG. 12 is a top view of the positioning and orientation of the alignment posts relative to the media frame tray module.

FIG. 12 shows the application of external force $F_{ext}$ (denoted in FIG. 12 by numerals F1, F2, F3, and F4) on the printer frame 12 from different directions. The partial frustoconical surfaces 464 and the flat portions 472, 472' of the respective alignment posts 242, 244 are positioned relative to media tray frame module 16 such that regardless of the direction of the externally applied force $F_{ext}$, the printer frame 12 engages with first surfaces 464. For example, if an external force F1 is applied from a front-to-back direction, first surface 464 of the alignment post 242 facing the front 34 of the media tray frame module 16 will engage with the printer frame 12. Similarly, if an external force F2 is applied in the direction shown, the first surface 464 of alignment post 242 facing the side 38 of the media tray frame module 16 will engage with the printer frame 12. In a similar manner, the first surface 464 of the alignment post 244 facing the side 40 will engage with the printer frame in response to external force F3, and first surface 464 of alignment post 244 facing back 36 will engage with the printer frame 12 in response to externally applied force F4 as shown. Thus, the diagonal positioning of the two alignment posts 242, 244 as well as the orientation of their flat surfaces 472, 472' ensure that the imaging apparatus 10 has sufficient anti-tip stability from any direction, and at the same time provides a means for relatively easy removal of the printer frame 12 from the media tray frame module 16.

It is understood that the present invention can also be used with any other device or equipment having multiple components stacked upon each other.

It will be apparent to those skilled in the art that various modifications and variations can be made to the present invention without departing from the spirit and scope of the invention. Thus, it is intended that the present invention cover the modifications and variations of this invention provided they come within the scope of the adapted claims and their equivalents.

What is claimed is:

1. An alignment post for an apparatus comprising:

a central section, the central section having a bore defined therein and a central axis substantially perpendicular to a horizontal plane;

a plurality of first surfaces disposed at least partly around and along the central section, each first surface flaring outwardly from a top end to a bottom end thereof such that the top end extends from the central section by an amount which is less than an amount by which the bottom end extends from the central section; and a plurality of second surfaces, each second surface inwardly tapered from the bottom end of a respective first surface to the top end of another of the plurality of first surfaces such that the first surfaces and the second surfaces alternate along the central section, each second surface making a predetermined acute angle with the horizontal plane.

2. The alignment post of claim 1, wherein the predetermined angle between each second surface and the horizontal plane is an acute angle ranging from about 10° to about 20°.

3. The alignment post of claim 1, wherein the plurality of first surfaces comprise at least three first surfaces and the plurality of second surfaces comprise at least three second surfaces.

4. The alignment post of claim 1, wherein the alignment post is configured for mounting on a frame module, the frame module being disposed below a frame of the apparatus such that the frame rests on the frame module.

5. The alignment post of claim 4, wherein the first surfaces and the second surfaces are disposed along the central section in a stacked arrangement, each of the second surfaces being positioned for engaging the frame and creating a counterforce that substantially prevents the frame and the frame module from separating when the frame moves relative to at least one second surface at a first contact angle.

6. The alignment post of claim 5, wherein when the frame moves relative to at least one second surface at a second contact angle, the counterforce created by engagement of the frame with the at least one second surface does not prevent the frame from being separated from the frame module, the second contact angle being different from and less than the first contact angle relative to the at least one second surface.

7. The alignment post of claim 1, wherein each of the plurality of first and second surfaces have at least one flat portion being substantially parallel to the central axis.

8. An apparatus having a system for providing anti-tip stability, comprising:

a frame including a bottom surface having at least one opening;

a frame module being disposed below the frame; and at least one alignment post disposed on the frame module such that the at least one alignment post is received within the at least one opening of the frame, the at least one alignment post having a central section with a bore, and a plurality of first surfaces disposed at least partly around and along the central section, each first surface flaring outwardly from a top end to a bottom end thereof, the at least one alignment post further comprising a plurality of second surfaces, each of the plurality of second surfaces being inwardly tapered from the bottom end of one of the plurality of first surfaces to the top end of another first surface such that the first and second surfaces alternate from a top of the alignment post to a bottom thereof, each second surface making a predetermined acute angle β with a horizontal plane.

9. The apparatus of claim 8, wherein the predetermined angle β is an acute angle less than or equal to about 20 degrees.

10. The apparatus of claim 8, wherein the central section has a central axis perpendicular to the horizontal plane, and wherein the top end of each first surface has a first diameter and the bottom end of each first surface has a second diameter, the first diameter being smaller than the second diameter.

11. The apparatus of claim 8, wherein each of the plurality of the first and second surfaces of the at least one alignment post has at least one flat portion being substantially parallel to the central section.

12. The apparatus of claim 8, wherein the frame engages with at least one second surface and prevents the frame and the frame module from substantially separating when the frame moves relative to the at least one second surface at a first contact angle.

13. The apparatus of claim 12, wherein the frame is separated from the frame module when the frame moves relative to the at least one second surface at a second contact angle, the first contact angle being different from and larger than the second contact angle.

14. The apparatus of claim 13, wherein the frame moves relative to the at least one alignment post due to application of an external tipping force on the frame that causes the frame to contact the at least one second surface while making one of the first contact angle and second contact angle with the second surface, thereby generating a force on the at least one second surface to which the frame makes contact, the force making an angle α with the horizontal plane.

15. The apparatus of claim 14, wherein the relation between the angle α, the predetermined acute angle β, and one of the first contact angle and second contact angle (γ) is given by the equation $\gamma=180°-(\alpha+\beta)°$.

16. The apparatus of claim 8, wherein the apparatus comprises two alignment posts disposed diagonally along the frame module.

17. The apparatus of claim 16, wherein each of the plurality of the first and second surfaces of each alignment post has at least one flat portion being substantially parallel to the central section, each flat portion faces a central portion of the frame module and each first surface faces an adjacent corner of said frame module.

18. An apparatus having a system for providing anti-tip stability, the apparatus comprising:

a frame including a bottom surface having at least two openings;

a frame module disposed below the frame; and at least two alignment posts disposed diagonally to each other along the frame module such that each of the alignment posts is received by one of the openings of the frame, each alignment post having a central section with a bore defined through the central section, and a plurality of first surfaces disposed substantially around and along the central section, each first surface extending outwardly and downwardly from the central section between a top end and a bottom end of the first surface, each alignment post further comprising a plurality of second surfaces, each of the plurality of second surfaces extending downwardly and inwardly between the bottom end of one first surface to the top end of another first surface, each second surface making a predetermined acute angle ranging from about 10° to about 20° with a horizontal plane.

19. The apparatus of claim 18, wherein each of the plurality of the first and second surfaces of each alignment post has at least one flat portion being substantially parallel to the central section.

20. The apparatus of claim 19, wherein the at least one flat portion of each alignment post is directed towards a central portion of the frame module.

21. The alignment post of claim 1, wherein the bore is substantially cylindrically shaped.

22. The apparatus of claim 8, wherein the bore is substantially cylindrically shaped.

23. The alignment post of claim 1, wherein for each first surface, the top end has a first diameter and the bottom end has a second diameter that is greater than the first diameter.

24. The apparatus of claim 18, wherein for each first surface, the top end has a first diameter that is smaller than a second diameter of the bottom end.

* * * * *